US007682693B2

(12) United States Patent
Molina et al.

(10) Patent No.: US 7,682,693 B2
(45) Date of Patent: Mar. 23, 2010

(54) FILLING MATERIAL

(75) Inventors: Agostino Molina, Cairate (IT); Jurgen Musch, Welver (DE)

(73) Assignee: ADVANSA B.V., NG Hoofddorp (NL)

( * ) Notice: Subject to any disclaimer, the term of this patent is extended or adjusted under 35 U.S.C. 154(b) by 0 days.

(21) Appl. No.: 11/912,642

(22) PCT Filed: Apr. 27, 2006

(86) PCT No.: PCT/EP2006/003907

§ 371 (c)(1),
(2), (4) Date: Feb. 26, 2008

(87) PCT Pub. No.: WO2006/114310

PCT Pub. Date: Nov. 2, 2006

(65) Prior Publication Data

US 2008/0193690 A1 Aug. 14, 2008

(30) Foreign Application Priority Data

Apr. 28, 2005 (EP) ..... 05009337

(51) Int. Cl.
*D02G 3/00* (2006.01)

(52) U.S. Cl. ..... 428/359; 428/362; 428/394

(58) Field of Classification Search ..... 428/359, 428/362, 394

See application file for complete search history.

(56) References Cited

U.S. PATENT DOCUMENTS

| | | | | |
|---|---|---|---|---|
| 3,050,821 | A | 8/1962 | Kilian | |
| 3,118,012 | A | 1/1964 | Kilian | |
| 3,454,422 | A | 7/1969 | Mead et al. | |
| 4,208,769 | A | 6/1980 | Morel | |
| 4,618,531 | A | 10/1986 | Marcus | |
| 4,783,364 | A * | 11/1988 | Ilan | 428/369 |
| 5,851,665 | A * | 12/1998 | Marcus | 428/357 |
| 5,891,568 | A * | 4/1999 | Hartzog et al. | 428/369 |
| 6,053,999 | A | 4/2000 | Marcus | |
| 6,492,020 | B1 | 12/2002 | Ahn et al. | |

FOREIGN PATENT DOCUMENTS

| | | |
|---|---|---|
| DE | 4319445 A1 | 12/1994 |
| EP | 0203469 A1 | 12/1986 |
| JP | 2002030555 | 1/2002 |
| WO | 9814646 A1 | 4/1998 |

* cited by examiner

*Primary Examiner*—N. Edwards
(74) *Attorney, Agent, or Firm*—Volpe and Koenig, P.C.

(57) ABSTRACT

A filling material for filling into articles of bedding and the like is presented and includes polyester fibres having an average dimension of 0.5 to 2.5 dtex and being coated with a slickener and crimped. The fibres have been cut to an average length of 4-15 mm and have subsequently been opened. In a method of forming a filling material a tow of slickened fibres of the above type is formed and crimped and is then cut to the above mentioned length. The cut fibres are then opened to form the filling material.

14 Claims, 4 Drawing Sheets

FILLING MATERIAL

FIELD OF INVENTION

The present invention relates to a filling material for filing into articles of bedding and the like.

The present invention further relates to a method of producing a filling material for filling into articles of bedding and the like.

The present invention also relates to a device for manufacturing a filling material for filling into articles of bedding and the like.

BACKGROUND

Fibre filling materials are used for filling into articles of bedding, such as pillows, sleeping bags and quilts, to provide a comfortable feeling and insulation.

EP 0 203 469 B1 describes one example of a fibre filling material in the form of refluffable fibre balls that are made from siliconized staple fibres that are entangled. The fibre balls according to that document are commercially available from ADVANSA Polyester GmbH, Hamm, Del. and sold under the trade marks Comforel® T-287, Comforel® supreme and others.

Although the fibre balls described in EP 0 203 469 B1 have excellent properties as a filling material providing an excellent bulkiness, i.e. ability to fill a large volume with a low mass of fibre balls, good softness, and good recovery from compression, it has, in some applications, a touch with a certain feeling of singular structures inside a pillow being filled with the fibre balls. Thus a pillow filled with the fibre balls may have a somewhat "grainy" feeling upon touch. This "grainy" feeling is negative to the soft touch feeling of the object, such as a pillow, into which the filling material is filled.

In applications where a "grainy" feeling is not desired it is often practice to fill the pillow with down or a combination of down and feathers. A filling material containing a combination of down and a substantial amount of feathers, such as 25-75% feathers, has a rather low ability to fill out a pillow, i.e. a poor bulkiness and thereby a "flat" feeling, and also provides an uncomfortable feeling since you can feel the hard central quill shafts of the large amount of feathers through the pillow fabric. A filling material containing mostly down, such as 90% down and only 10% feathers, is on the other hand very expensive and has a too quick recovery after compression. By this is meant that an object, such as a pillow, filled with such an exclusive down material will, after compression, very quickly return to its original size. Thus the pillow filled with mostly down might give a feeling with too quick recovery after compression. Such a "springy" feeling, which may also be felt in the Comforel® T-287 material, is negative to the feeling of conformability to the body by the filling material. By conformability is meant the pressure on a part of a body, such as a head, which is exerted by an object, such as a pillow. A good conformability, which is a desirable characteristic, means that a low pressure is exerted by the pillow on the head of a person lying on the pillow. It is difficult to obtain a combination of feathers and down that provides both a good bulkiness and a high conformability.

SUMMARY

An object of the present invention is to provide a fibre filling material which provides a large bulkiness, i.e. a large capability of filling a large volume with a low weight of material, and additionally a slow recovery after compression, and thereby a good conformability, and a high relative softness which in combination provides a very attractive subjective softness.

This object is achieved by a filling material for filling into articles of bedding and the like, characterized in that the filling material comprises polyester fibres having an average dimension of 0.5 to 2.5 dtex and being coated with a slickener and crimped, the fibres being cut to an average length of 4-15 mm and opened.

An advantage with this filling material is that it provides a very soft touch feeling to an object into which it is filled and a good conformability. This makes the filling material suitable for replacing exclusive types of down in applications, such as high class pillows, in which soft feeling and conformability is a very important aspect. In comparison with high quality polyester filling materials, such as Comforel® T-287, the filling material of the present invention provides a less "grainy" feeling. In relation to down the inventive filling material provides an improved combination of high bulkiness, good conformability and soft feeling.

Another purpose of the present invention is to provide an efficient method of forming a filling material suitable for filling into bedding articles and the like in which a soft feeling and good conformability is very important.

This object is achieved by a method according to the preamble and characterized by the steps of providing a tow of slickened polyester fibres with an average dimension of 0.5 to 2.5 dtex, crimping the fibres, cutting the fibres to an average length of 4 to 15 mm, and opening the fibres.

An advantage of this method is that it provides an efficient way of manufacturing a synthetic filling material with very good conformability properties. Another advantage of this product in relation to web-shaped products is that the product of the invention is easily transported and filled into objects, such as pillows, by being transported by means of an air stream.

Another object of the present invention is to provide a device which is useful in forming the material of the invention.

This object is achieved by a device according to the preamble and characterized in that the device comprises a first opening section comprising a first gap formed between a first rotating opening roller and an adjacent surface, the first opening roller being provided with protruding structures on its surface, a first feeding device for feeding slickened and crimped polyester fibres having an average dimension of 0.5-2.5 dtex and an average cut length of 4 to 15 mm into the first gap, a second opening section comprising a second gap formed between a second rotating opening roller and an adjacent surface, the second opening roller being provided with protruding structures on its surface, a second feeding device for feeding partially opened polyester fibres from the first opening section into the second gap in which the fibres are opened by the second opening roller, and a transporting device for transporting filling material from the second opening section to a storage.

An advantage with this device is that it provides a very efficient opening of the cut fibre material. Since the opening degree of the fibres is correlated to the bulkiness, and thereby to the conformability and softness, of the filling material, an efficient opening device provides for a low cost production of the filling material.

According to a further aspect of the present invention an article of bedding, or the like, is characterized in that said article is at least partly filled with the filling material described hereinbefore.

These and other objects of the invention will be further described and elucidated in the following description and the appended claims.

BRIEF DESCRIPTION OF THE DRAWINGS

The invention will now be described in more detail with reference to the appended drawings.

DETAILED DESCRIPTION OF THE PREFERRED EMBODIMENTS

Figure 1:
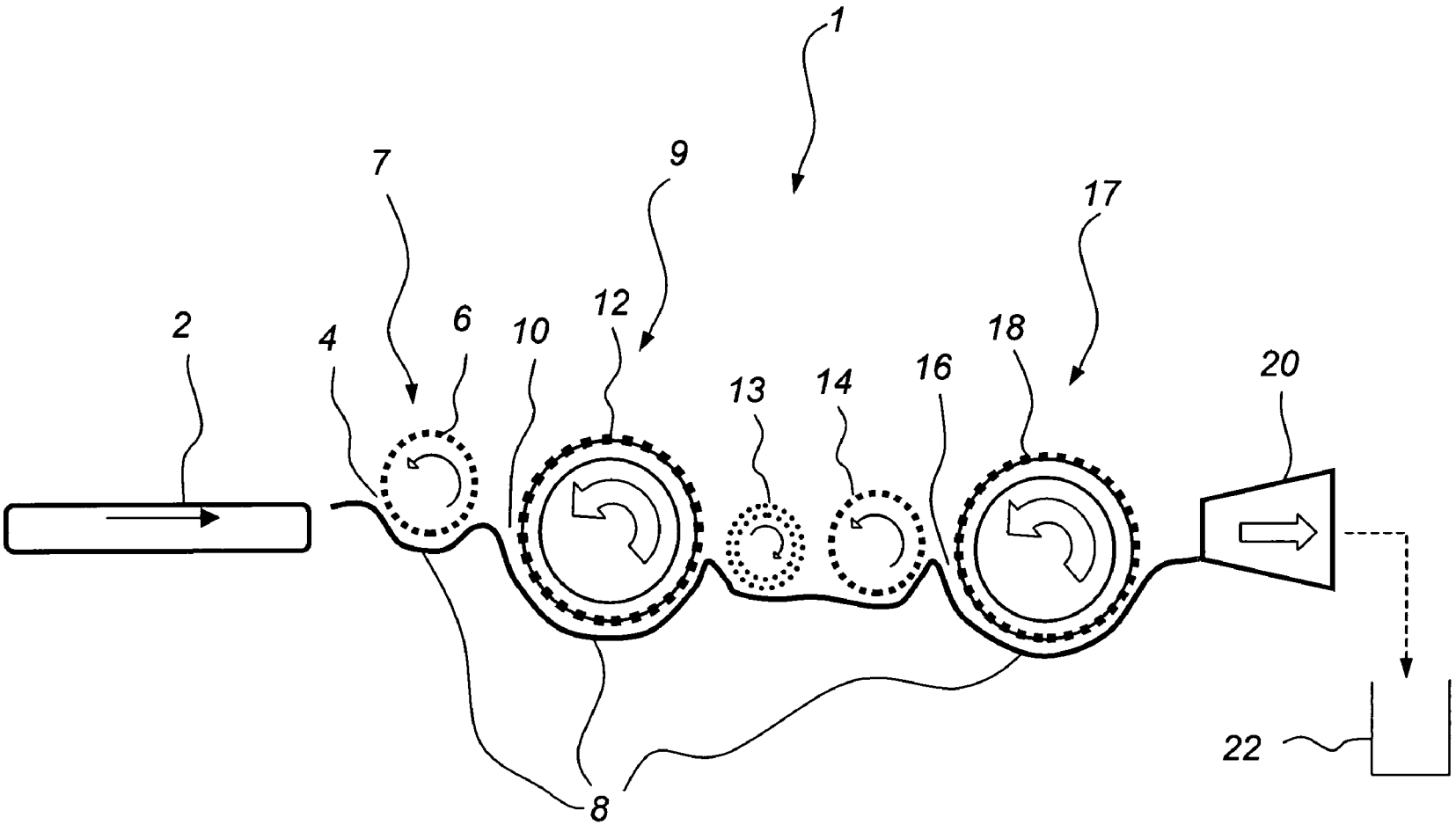
FIG. 1 is a schematic side view and shows an opening device which could be used in preparing the material according to the invention.

The present invention relates to a fibre filling material and in particular a filling material for filling into articles of bedding and the like. By articles of bedding is meant in particular sleeping pillows, quilts, sleeping bags, mattresses and mattress pads. In addition to this the material could be used as a filling material in furniture related objects, such as cushions for sofas, armchairs and decorative pillows, that are used in homes and in which a soft feeling is desired.

The fibre filling material is characterized in that it comprises polyester fibres having an average dimension of 0.5 to 2.5 dtex and being coated with a slickener and crimped, the fibres being cut to a length of 4-15 mm and opened.

The polyester fibres could be obtained, for instance, by extruding polyester fibres as known in the art. An important aspect of the invention is that the polyester fibres need to have a certain average dimension, i.e., a certain cross-sectional size. The standard measure for the average fibre dimension is tex, or more often dtex. In the present invention the average fibre dimension is to be in the range 0.5 to 2.5 dtex. A fibre dimension of lower than 0.5 dtex is difficult to manufacture and to open and provides limited, if any, additional improvement in softness and conformability. According to a more preferred embodiment the average fibre dimension is larger than 0.8 dtex. A fibre dimension in this range can be effectively manufactured, provides a soft filling material and is easy to open. A fibre dimension of larger than 2.5 dtex significantly reduces the softness of the fibre filling material. A fibre dimension of less than 2.0 dtex provides a very soft material with excellent properties as regards opening and filling into an end product. According to the most preferred embodiment the fibre dimension is about 1.5 dtex or lower, since such a dimension provides a particularly soft filling material. Thus the most preferred embodiment is an average fibre dimension in the range of about 0.8 to 1.5 dtex.

The extruded polyester fibre need to be slickened. This is obtained by coating the fibres with a slickener, preferably a silicone slickener, e.g. as described in U.S. Pat. No. 3,454,422. The slickener makes the fibres easier to open and thus provides for separating the fibres from each other. The fibres of the present invention may alternatively be slickened with other slickening agents which may be advantageous in some applications, such as segmented copolymers of polyalkyleneoxide and other polymers, such as polyester, or polyethylene or polyalkylene polymers as is mentioned in U.S. Pat. No. 6,492,020 B1, with the weight percent of the slickener being from about 0.1 to about 1.2% per weight of the fibres.

To obtain the desired properties of the inventive fibre filling material it is necessary to provide the polyester fibres with a crimp. One example of a suitable crimp is the so called zig-zag crimp, also called mechanical crimp. This type of crimp, which is per se known, is obtained by passing a tow of extruded fibres through a narrow gap between two crimp rollers. Further examples of mechanical crimp methods are referred to in EP 929700 A1 and U.S. Pat. No. 6,492,020 B1. Another crimp type is the spiral crimp. A spiral crimp is, contrary to the two-dimensional zig-zag crimp, three-dimensional. A spiral crimp could be obtained by, for example, the methods described in U.S. Pat. No. 3,050,821, U.S. Pat. No. 3,118,012, EP 929700 A1 and U.S. Pat. No. 6,492,020 B1. Preferably the crimp frequency is adjusted so that each cut fibre, at the given cut length, is provided with at least one or two crimps. Further it will be appreciated that both solid and hollow fibres could be used as well as fibres of different cross-sections.

The crimped fibre is cut to an average length in the range of 4-15 mm. An average fibre length of less than 4 mm does not make the fibre filling material hold together in the desired manner and does thus not provide the desired bulkiness and compression characteristics. An average fibre length of more than 15 mm does not provide the desired slow return to original shape after compression, often referred to as a low work recovery, and soft touch feeling. Most preferably the average fibre length should be less than about 12 mm and more than about 6 mm to provide a material with particularly good bulkiness value and softness. A most preferred filling material would thus be based on fibres having an average fibre dimension of about 0.8 to about 1.5 dtex and an average fibre length of about 6 mm to about 12 mm.

The opening of the fibres means that the bundles of fibres resulting from the cutting of the tow of fibres is worked upon such that the individual fibres become separated from each other. A proper opening provides the desired soft feeling and the bulkiness required for filling into objects, such as pillows. The opening could be made in several different ways, such as by exposing the cut fibres to a device having mechanical elements, such as pins, working the fibres at a high speed. It is also possible to use an air opener in which the cut fibres are exposed to a turbulent air stream. Other opening methods, including manual opening, are also possible. In general the opening of the fibres of the present invention is more difficult than the opening of the coarse fibres of longer cut length of the prior art. Thus it is sometimes necessary to expose the cut fibres to several opening steps, a more potent mechanical treatment or a higher gas velocity in the case an air opener is used. In view of this it is preferred that the fibres are of high quality and do not have a too small average dimension and length, since this may increase the loss of material and the generation of airborne fibres during opening. In particular polyester fibres have proven to withstand this type of opening very well.

Preferably the cut fibres are opened to such a degree that the bulkiness value, which is defined in more detail below, is at least 160 mm. The bulkiness value is an indirect measure of how well the opening has succeeded. Since the bulkiness value is easy to measure according to the specification included below it can be used in adjusting the opening procedure, for instance in order to adjust the number of cycles the fibre material is passed through the opener, the rpm of one or several rollers mechanically working the fibres or another relevant parameter. Still more preferably the fibres are opened to such a degree that the filling material obtains a bulkiness value, as defined below, which is at least 180 mm, most preferably at least 200 mm. A filling material comprising fibres opened to this degree provides a particularly soft feeling and, in addition, is very well suited for filling into objects, such as pillows, in which a high bulkiness is an important quality factor.

Preferably the fibre filing material has a work recovery value of less than 52%. Work recovery, which is defined below, describes how fast the filling material returns to its original shape and size after having been compressed. A high work recovery value means that the material returns rather quickly to its original size and this gives a somewhat "springy" feeling. Thus a low work recovery value, and thus a slow return to original shape and size, is desired. A low work recovery value means a good conformability to the head of a person lying on the pillow, or any other object filled with the filling material. A low work recovery value additionally contributes to the subjective soft feeling of the object in which the filing material is filled. The nature of the work recovery value is such that a small decrease in work recovery, for example from 55% to 52%, corresponds to a significant increase in the conformability and the subjective soft feeling.

Preferably the fibre filling material is essentially made of slickened polyester fibres. It has been found that a fibre filling material that comprises essentially only polyester fibres gives good processing properties, outstanding softness, accurate product quality control and easy recycling of used fibres.

FIG. 1 is a schematic cross section and illustrates one type of opener 1 that has proven to be efficient in opening the fibres used in the present invention. The opener 1 comprises a first feeding device in the form of a conveyor belt 2. The conveyor belt 2 feeds cut staple fibres into an entrance gap 4 which is formed between a feed roller 6 and a metal plate in the form of an apron 8 that has a smooth surface. The entrance gap 4, the feed roller 6, and that part of the apron 8 being adjacent to the feed roller 6 form together a feed section 7 in which the fibres are being clamped, i.e. the fibres are densified at the exit of the feed section 7, before being forwarded to the actual opening sections. Depending on the amount of feed material the entrance gap 4 may typically have a width of 3-6 mm. The feed roller 6 is saw tooth wired by which is meant that a wire having teeth is wound around the surface of the roller 6. The fibre filling material is forced through the entrance gap 4 by the feed roller 6 and is forwarded to a first gap 10 formed between a first opening roller 12, which is also saw tooth wired, and the smooth apron 8. The first gap 10 has, as shown in FIG. 1, the shape of a wedge with its narrowest distance adjacent to its outlet where the actual opening mainly takes place. The first gap 10, the first opening roller 12, and that part of the apron 8 being adjacent to the roller 12, form together a first opening section 9. The first opening roller 12, being provided with teeth, works the cut fibre against the apron 8, having a smooth surface, in the first gap 10 and causes partial opening of the fibres. The first gap 10 may typically have a width of 1.5-3 mm at its narrowest distance. The partially opened fibres then reach a perforated roller 13. The perforated roller 13, having a clockwise direction of rotation and a smooth surface, is connected to a suction and sucks the fibres onto its surface. The perforated roller 13 forms a fibre matt of the partially opened fibres exiting the first opening section 9 and forwards the fibres to a subsequent section. Further the suction provides removal of any dust formed in the first opening section 9. A second feeding device in the form of a feed roller 14, being similar to the feed roller 6, forwards the partially opened fibres to a second gap 16 formed between a second opening roller 18, which is also saw tooth wired, and the smooth apron 8. The second gap 16 has, as shown in FIG. 1, the shape of a wedge with its narrowest distance adjacent to its outlet where the actual opening mainly takes place. The second gap 16, the second opening roller 18, and that part of the apron 8 being adjacent to the roller 18, form together a second opening section 17. The second opening roller 18, being provided with teeth, works the cut fibre against the apron 8, having a smooth surface, in the second gap 16 and causes final opening of the fibres. The second gap 16 may typically have a width of 1-1.5 mm at its narrowest distance. The opened fibres are then removed by means of a vacuum device 20 and are then forwarded to a storage 22 or are directly filled into a pillow, a quilt or another object.

Thus, an entanglement step is unnecessary by the present invention. The filling material of the present invention, can, as stated hereinbefore, be filled into a pillow, a quilt, or another object, directly after said opening of the fibres, or the filling material can be forwarded, directly after said opening of the fibres, to a storage, prior to being filled into a pillow, a quilt or another object. In either case, an unentangled filling material is, thus, preferably employed. In some cases an entanglement of the opened fibres may even deteriorate the properties of the filling material of the present invention.

The saw tooth wire provided on the first opening roller 12 could typically be designed to provide a density of 20-60 teeth/square inch on the surface of the roller 12. The teeth could typically extend a distance of 4-9 mm from the surface of the roller 12. The saw tooth wire of the second opening roller 18 could typically be designed to provide a density of 70-120 teeth/square inch on the surface of the roller 18. The teeth could typically extend a distance of 4-9 mm from the surface of the second roller 18.

EXAMPLE 1

A tow of drawn slickened polyester fibres of 1.3 dtex was prepared according to conventional methods and was then mechanically crimped to obtain a zig-zag crimp. The draw ratio was about 2.8×, a commercial slickener comprising aminofunctionalpolydimethylsiloxane was used for slickening, and the relaxation temperature was about 170° C. thus curing the slickener on the tow. The tow was then cut to a fibre length of 10 mm and baled. In order to open the fibres a bale of fibres was introduced in a bale opener, which caused some initial opening of the fibres. The cut fibres were then introduced, at a feed rate of 100 kg/h, in a Laroche opener of the type Opener Cadette 1000, machine nr 2232-00203-001, which is available from Laroche S.A., Cour de la Ville, FR. This opener is usually used for treating recycled fibre and is therefore provided with a saw tooth wired feed roller, having a diameter of 96 mm, followed by a first and a second opening roller, one after the other, designed to work the cut fibre against a smooth apron, similar to what is shown in FIG. 1. The first opening roller, which is adapted to rotate at 3000 rpm, has a diameter of 350 mm and is provided with a saw tooth wiring of type PLATT V10L/6STL, available from ECC Platt SA, Roubaix, FR, on its surface. The density of saw teeth on the surface of the first opening roller was about 48 teeth/square inch (also referred to as: points per square inch; ppsi). The width of a first gap between the first opening roller and the apron was about 2 mm. The second opening roller, located downstream of the first opening roller and adapted to rotate at 3000 rpm, has a diameter of 350 mm and is provided with a saw tooth wiring of type PLATT V12/4709. The density of saw teeth on the surface of the second opening roller was about 90 teeth/square inch. The width of a second gap between the second opening roller and the apron was 1.2 mm. A vacuum device was mounted on the opener to gently and without clumping transport the opened fibres from the exit of the gap between the second opening roller and the apron and to a bulk material filling station.

Figure 2:
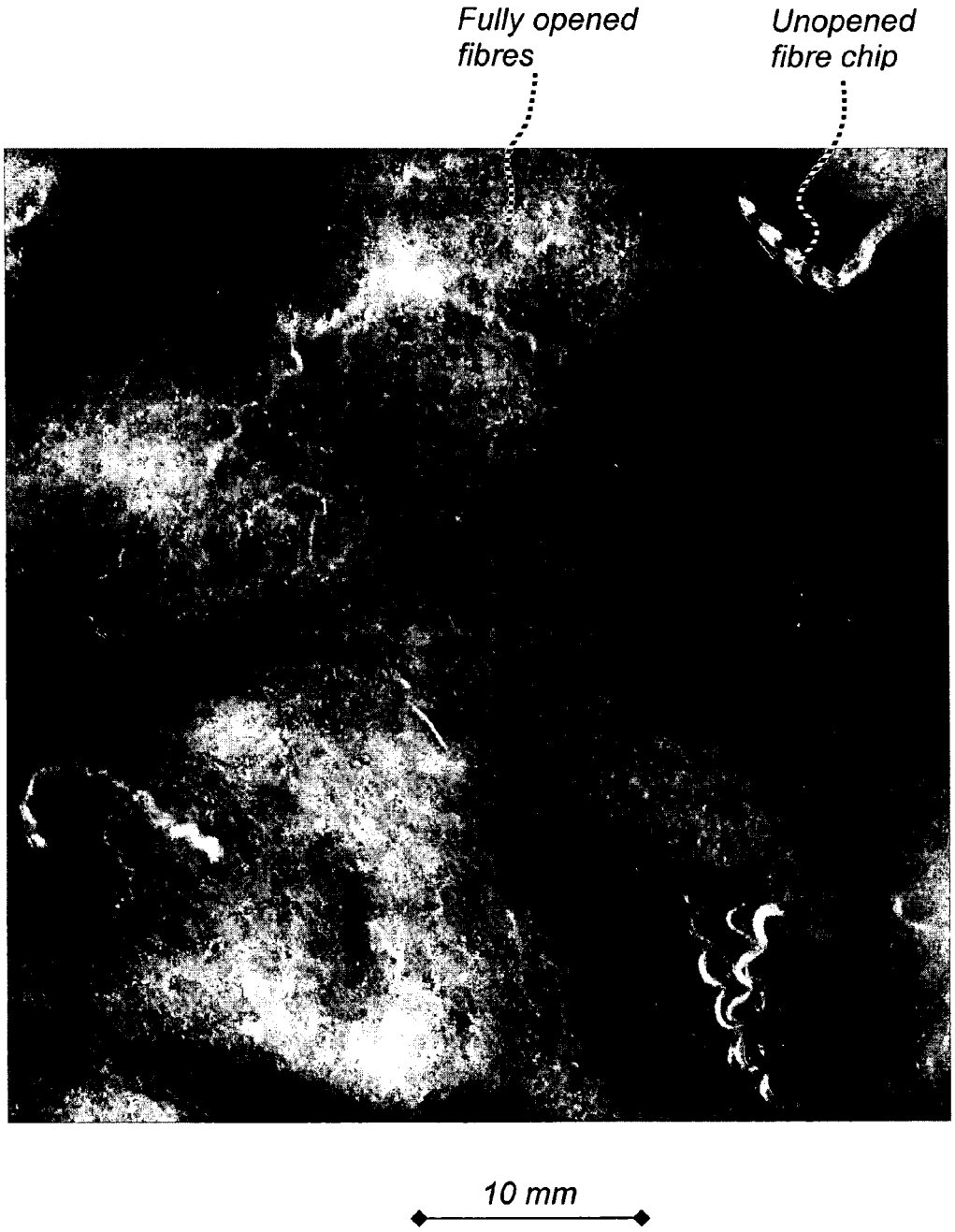
FIG. 2 is a photograph and shows, in an enlarged view, the fibre filling material according to Example 1.
Figure 3:
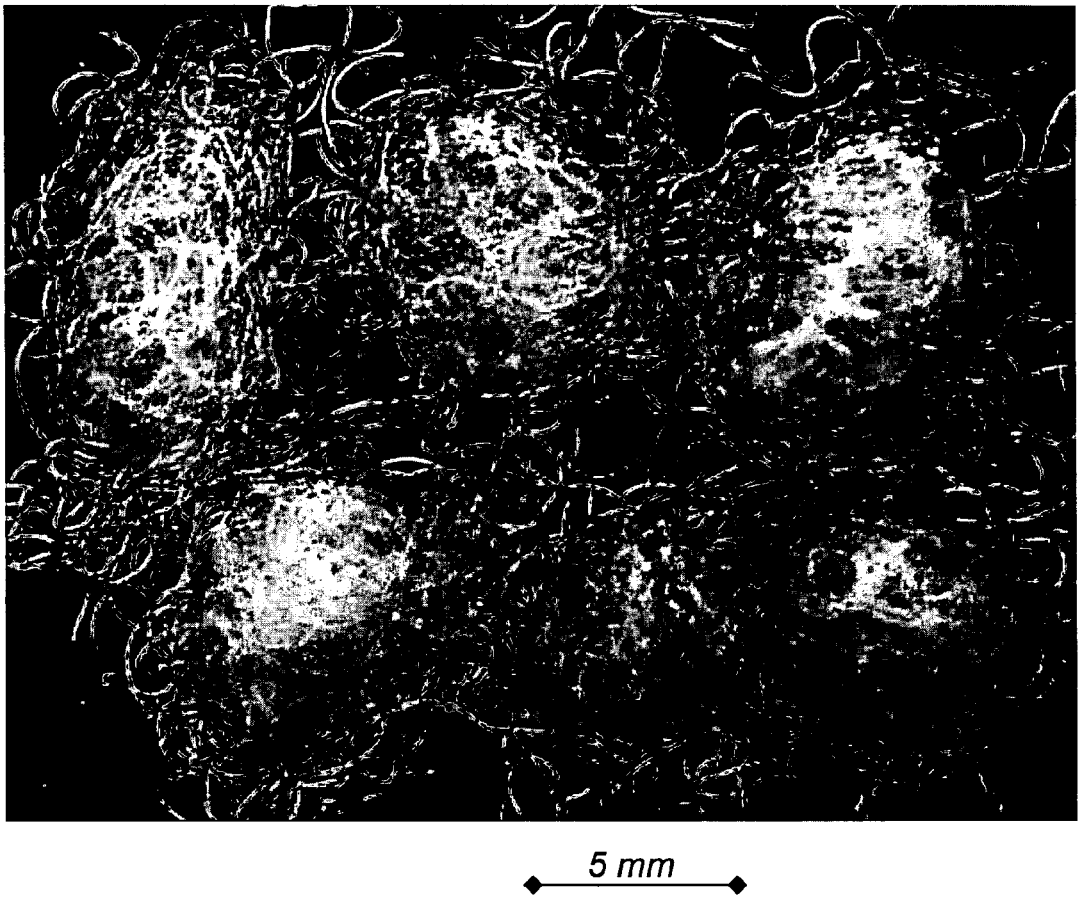
Prior art Fig. 3
FIG. 3 is a photograph and shows, in an enlarged view, a fibre cluster material according to the prior art.

The resulting fibre filling material is shown in FIG. 2. It can be seen that the fibre filling material has a voluminous and soft-looking appearance. In comparison with natural down, which for instance is shown in FIG. 1A of U.S. Pat. No. 6,053,999, the fibre filling material of the invention has less "loose threads" and gives a similar "fluffy" impression. The subjective feeling, when touching the fibre filling material of the invention with the hand, is that the filling material has a very soft feeling to the hand. As is shown in FIG. 2 there are still a small amount of unopened fibre chips, by which is meant fibre aggregates in which the individual fibres have not been properly separated from each other. The amount, and volume, of the fully opened fibres is however such that the negative effect to bulkiness value and soft touch feeling caused by those unopened fibre chips is negligible.

A total amount of 600 g of this inventive fibre filling material was put in a 60×60 cm test pillow ticking, as defined below, and was then tested according to the test method described below.

COMPARATIVE EXAMPLE A

For this comparative example, a test pillow, having the same size and fabric used for ticking as that of Example 1, was filled with 600 g of a fibre filling material called "Comforel® T-287", which is available from ADVANSA Polyester GmbH, Hamm, Del. This material is a high-quality fibre ball filling material used for filling in particular pillows.

COMPARATIVE EXAMPLE B

For this comparative example, a test pillow, similar to that described above, was filled with 600 g of a filling material named "Polish goose", which was marketed by Betten Reinhard GmbH & Co. KG, D-59065 Hamm, Del. This material, which is a low cost material of a type often called "¾ down", is often used for filling pillows and contained 30% down and 70% feathers.

COMPARATIVE EXAMPLE C

For this comparative example, a test pillow, similar to that described above, was filled with 600 g of a filling material named "Country goose down from Pyrenees", which was marketed by Betten Reinhard GmbH & Co. KG, D-59065 Hamm, Del. This material, which is an exclusive material used for filling pillows, contains 90% down and 10% feathers.

Compression Tests:

The compression tests were made by putting the filling material into a pillow of a well defined size and fabric. The filling of the pillow was made by means of a filling apparatus Type: J 113 b available from L.H. Lorch AG, Esslingen, Del. The pillow is then subjected to a first compression cycle, then pressure is released, and then a second compression cycle is run, followed by a final release. The specifics of the test method is described below under the corresponding heading. The test results can be found in table 1.

TABLE 1

Results of compression measurements

| Aspect | Unit | Example 1 | Comp A | Comp B | Comp C |
|---|---|---|---|---|---|
| Initial Height 1:st cycle at 12 Pa | mm | 236.6 | 215.5 | 210.4 | 235.2 |
| Initial Height $2^{nd}$ cycle at 12 Pa* | mm | 205.6 | 195.8 | 174.4 | 207.9 |
| Height at 62 Pa** | mm | 202.4 | 192.3 | 168.6 | 203.1 |
| Height at 156 Pa** | mm | 196.6 | 185.9 | 158.8 | 195.3 |
| Height at 313 Pa** | mm | 185.8 | 175.6 | 143.1 | 181.7 |
| Height at 938 Pa** | mm | 144.6 | 144.5 | 94.9 | 137.3 |
| Height at 1875 Pa** | mm | 102.6 | 114.6 | 60.3 | 94.1 |
| Height at 3125 Pa** | mm | 69.3 | 88 | 40.6 | 64.0 |
| Softness Absolute** | mm | 61.0 | 51.4 | 79.5 | 70.7 |
| Softness Relative** | % | 29.7 | 26.2 | 45.6 | 34.0 |
| Work recovery** | % | 49.8 | 53.3 | 53.2 | 62.4 |

*Initial height at 12 Pa pressure, 2nd cycle is equal to the Bulkiness value
**Values refer to second cycle The bulkiness value of the inventive material, Example 1, is 205,6 mm (equal to the initial height at 12 Pa, $2^{nd}$ cycle). As can be seen from above the inventive fibre filling material of Example 1 has the lowest work recovery, as low as 49,8%, which means a good conformability and is an indicator of the subjective softer touch feeling of the inventive material. In comparison with Comparative example A the inventive material is better in both Work recovery, Softness and Bulkiness value. In addition to this the inventive material of Example 1 does not have the somewhat "grainy" feeling of Comparative example A, containing fibre balls, and had also a better conformability and a subjective softer feeling.

In comparison with Comparative example B, containing 30% down and 70 feathers, the inventive material has a much better Bulkiness value.

In comparison with Comparative example C, 90% down and 10% feathers, the inventive material has a much better Work recovery value which means a slower increase in volume after compression force has been removed. In general this gives a better conformability and a subjective softer feeling.

Thus it can be seen that none of the Comparative examples shows the same attractive combination of high Bulkiness value and low Work recovery value.

Thermal Resistance Tests:

The thermal resistance tests were made in order to test the ability of the inventive filling material to be used in a quilt. The tests were made according to the standard test procedure described below.

For the thermal resistance tests two quilts were prepared, each in correspondence with the standard test procedure. A first quilt, Quilt 1, was prepared using the same inventive fibre filling material as is described above with reference to Example 1. A second quilt, Comparative Quilt, was prepared using a fibre filling material named Trevira Fill Fibelle, which is available from Trevira GmbH, Frankfurt/Main, DE. The filling materials where filled into the same type of fabric enclosure, according to the standard test procedure, having a cassette type fabric having totally 24 square cassettes, 6 in the length and 4 in the width of the quilt. The following results on Thermal resistance, R, and Warmth-to-weight ratio, R/G, were obtained:

TABLE 2

Results of thermal resistance tests.

| | Unit | Quilt 1 | Comparative quilt |
|---|---|---|---|
| Width of quilt | cm | 136.5 | 137 |
| Length of quilt | cm | 201 | 202 |
| Weight of quilt | g | 1903 | 1922 |
| R | tog | 8.9 | 7.5 |
| R/G | tog × $cm^2$/g | 128 | 108 |

As is clear from Table 2 the fibre filling material according to the present invention, Quilt 1, has considerably better Warmth-to-weight ratio, R/G, than the Comparative quilt filled with the material Trevira Fill Fibelle. Thus the fibre filling material according to the invention has proven suitable for filling into quilts since it has, in addition to the good bulkiness and softness illustrated above, also good insulation properties.

It will be appreciated that numerous modifications of the embodiments described above are possible within the scope of the appended claims.

Thus for example the opening device could have another design than the one shown in FIG. 1. The opening device shown in FIG. 1 has a first opening section and a second opening section. It will be appreciated that the opening device could be provided with even more opening sections, such as three or four opening sections in series. It is also possible to allow the fibres to pass through the opener more than one cycle. It is thus, for example, possible to use a single opening section and pass the fibres two times through that opening section. It is often preferred, however, to use two opening sections in series, as shown in FIG. 1, since the design, as regards saw tooth wiring, gap width etc, can be optimised for each section.

As already mentioned other types of opening could be used as well, such as for example opening by means of exposing the fibres to a turbulent air stream. In general the fibres of the present invention are rather difficult to open and therefore an air opening device may be designed with a higher pressure difference than a standard air opener. Further the air opening is preferably performed as a multistep process in which several air openers are arranged in series to open the fibres gradually.

Measurement Methods:

Compression Measurement Procedure:

The above referenced compression measurement data were obtained using the following method:

Firstly 600 g of filling material was filled into a pillow of 60×60 cm. The pillow had, in the above referenced tests, a fabric made from a material having the following specification and specified as down-proof: 100% cotton, plain weave, warp and weft yarn count Nm 70, warp thread count 52/cm, weft thread count 39/cm. A pillow fabric of this type is available from Melchers Inlett & Outdoor GmbH, Bremen, Del. The pillows are made in China and are specified as: Down-proof, Size 60×60 with a 58 cm long zipper.

After filling the fabric with the filling material the pillow was mashed in the opposite corners of the ticking several times (to refluff the pillow). Prior to the testing the pillow was conditioned at a relative humidity of 65% (±2%) and a temperature of 20° C. during 24 hours. The pillow was then placed on the table, 80×80 cm, of a universal test control unit Instron type 5564 available from Instron Corporation, Norwood, Mass., USA.

The measurement included exposing the pillow to a compression in a first cycle (initiating cycle) and a second cycle (measurement cycle). The compression was, in both cycles, performed by forcing a flat circular plate with a diameter of 201,85 mm into the pillow. The plate was moved with a velocity of 100 mm/min into the pillow while the pressure was measured by a load cell located under the table and the corresponding distance between the circular plate and the table was registered. The circular plate was forced into the pillow (compression phase) until a pressure of 3125 Pa was registered. Then the circular plate was retracted from the pillow (release phase) at a velocity of 100 mm/min, while still registering the pressure and the distance. After the first cycle the pillow is left at a remaining pressure of 4 Pa for 60 seconds. Then the second cycle is started and performed in a similar manner as the first cycle. From the first cycle only the initial height, measured at 12 Pa, was noted. From the second cycle the initial height, measured at 12 Pa, and the heights at certain pressures were registered.

Absolute Softness:

The absolute softness (in mm) was calculated as the difference between the height at 12 Pa and the height at 938 Pa in the second cycle.

Relative Softness:

The relative softness (in %) was calculated as the absolute softness divided by the height at 12 Pa at the second cycle.

Figure 4:
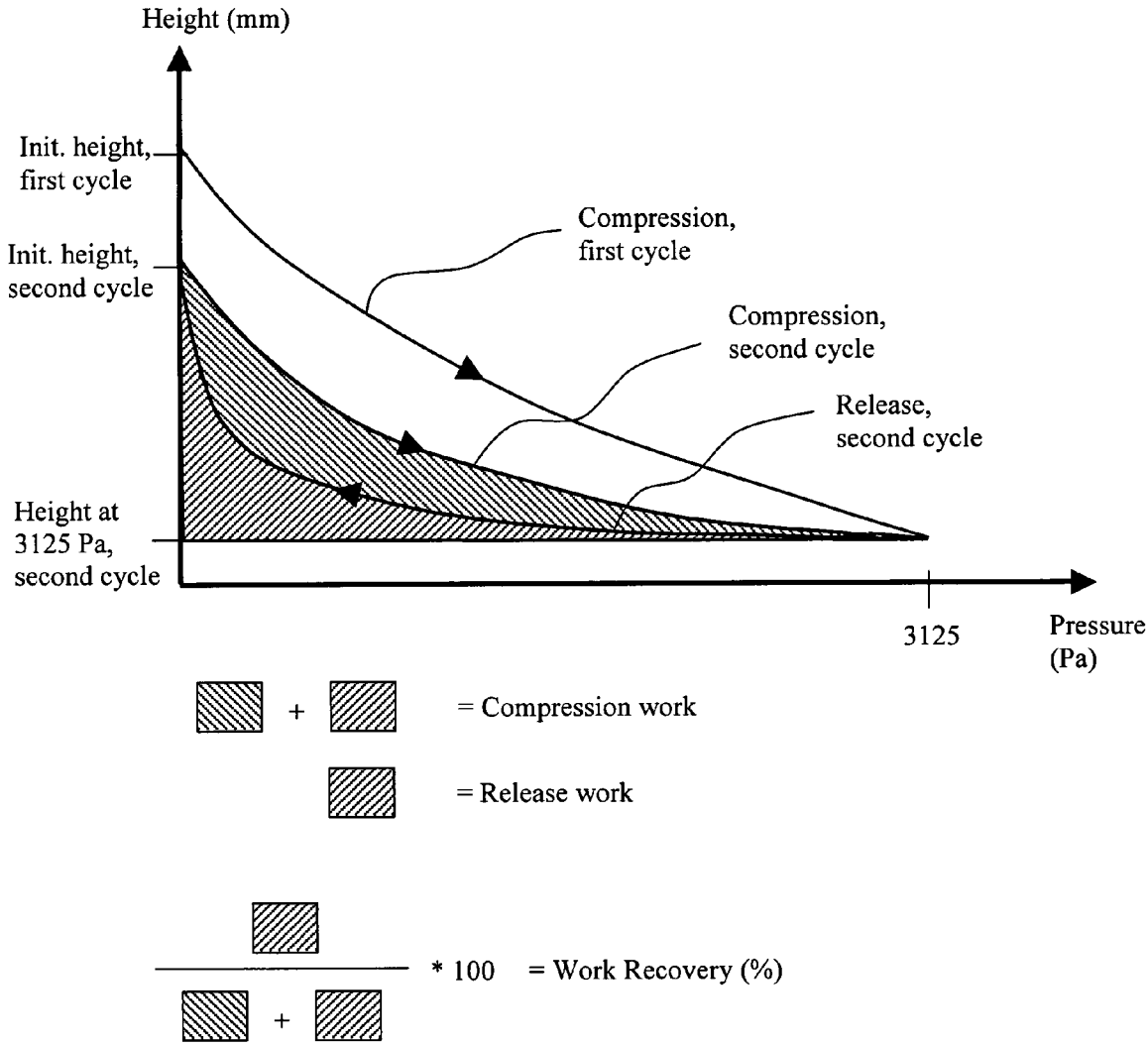
FIG. 4 is a diagram and illustrates the measurement of work recovery value.

Work Recovery:

The Work recovery (WR) in % was calculated as the release work divided by the compression work, as is illustrated in FIG. 4. The compression work is the work, in Joule, required to compress the pillow to 3125 Pa at the second cycle. The compression work is calculated as the area under the compression curve traversing from the initial height at 12 Pa to the compressed height (i.e. the height at 3125 Pa). The release work is calculated as the area under the release curve traversing from the compressed height (the height at 3125 Pa) and back to the height at 12 Pa in the second cycle. After calculating the release work and the compression work the work recovery, in %, may be calculated.

Bulkiness Value:

The bulkiness value of a filling material is, in the present application, defined as the initial height (at 12 Pa) in mm in the second cycle of the compression test defined above.

Thermal Resistance Test Procedure:

The thermal resistance tests were performed in accordance with British Standard Specification BS 5335:1984. In short a quilt containing the filling material that is to be tested is placed on top of an electrical heating plate. The electrical heating plate is heated to 33° C.

Based on temperature measurements the Thermal resistance R of the quilt can be calculated. The Thermal resistance R is expressed in the unit tog. 1 tog is ten times the temperature difference between the two faces of a quilt when the heat flow rate across unit area is equal to 1 W/$m^2$ Based on the Thermal resistance R, in togs, it is possible to calculate the Warmth-to-weight ratio, R/G. This is a measure of the efficiency of the quilt as a heat insulator in relation to its filling weight per $cm^2$. R/G is equal to the ratio of the thermal resistance, R, (in togs) of the quilt to the mass of the quilt per unit area (in g/$cm^2$).

The invention claimed is:

1. A filling material for filling into articles of bedding, the filling material comprising polyester fibres having an average dimension of 0.5 to 2.5 dtex and being coated with a slickener and crimped, the fibres being cut to an average length of 4-15 mm and opened.

2. A filling material according to claim 1, wherein the polyester fibres are opened to such a degree that the filling material has a bulkiness value of at least 160 mm.

3. A filling material according to claim 1, wherein the polyester fibres are opened to such a degree that the filling material has a bulkiness value of at least 180 mm.

4. A filling material according to claim 1, wherein the filling material has a work recovery value of less than 52%.

5. A filling material according to claim 1, wherein the polyester fibres have an average dimension of 0.8 to 2.0 dtex.

6. A filling material according to claim 1, wherein the filling material is essentially made of slickened polyester fibres.

7. A filling material according to claim 2, wherein the filling material has a work recovery value, of less than 52%.

8. A filling material according to claim 3, wherein the filling material has a work recovery value, of less than 52%.

9. A filling material according to claim 7, wherein the polyester fibres have an average dimension of 0.8 to 2.0 dtex.

10. A filling material according to claim 8, wherein the polyester fibres have an average dimension of 0.8 to 2.0 dtex.

11. A filling material according to claim 3, wherein the filling material is essentially made of slickened polyester fibres.

12. A filling material of claim 1, wherein the polyester fibres are opened to such a degree that the filling material has a bulkiness value of at least 200 mm.

13. A filling material of claim 2, wherein the polyester fibres are opened to such a degree that the filling material has a bulkiness value of at least 200 mm.

14. A filling material according to claim 4, wherein the polyester fibres have an average dimension of 0.8 to 2.0 dtex.

* * * * *